US006631524B1

(12) United States Patent
Dixon

(10) Patent No.: US 6,631,524 B1
(45) Date of Patent: Oct. 14, 2003

(54) HEIGHT-ADJUSTABLE FOOTREST FOR TOILETS

(76) Inventor: Marcia A. Dixon, 88 E. 46$^{th}$ St., Brooklyn, NY (US) 11203

( * ) Notice: Subject to any disclaimer, the term of this patent is extended or adjusted under 35 U.S.C. 154(b) by 0 days.

(21) Appl. No.: 10/217,263

(22) Filed: Aug. 13, 2002

(51) Int. Cl.$^{7}$ ..... E03D 11/00
(52) U.S. Cl. ..... 4/254; 297/423.45
(58) Field of Search ..... 4/254; 248/371; 297/423.39, 423.41, 423.43, 423.44, 423.45, 423.46

(56) References Cited

U.S. PATENT DOCUMENTS 2,083,605 A * 6/1937 Jeretberg ..... 4/254
2,248,369 A * 7/1941 Ludersen ..... 248/371
4,584,725 A * 4/1986 Oliver ..... 4/254
5,809,583 A * 9/1998 Pucciani ..... 4/254
6,113,182 A * 9/2000 Wise ..... 297/119
6,148,448 A * 11/2000 Urso ..... 4/254
6,199,228 B1 * 3/2001 Kallweit ..... 4/667

* cited by examiner

*Primary Examiner*—Charles E. Phillips

(57) ABSTRACT

A height-adjustable footrest for toilets for preferably using while a user is seated upon a toilet stool. The height-adjustable footrest for toilets includes a base being adapted to rest upon a floor; and also includes upright adjustable support assemblies being mounted upon the base and including tubular base members each having an open top end and a bore extending therein, and also including shaft members being movably disposed inwardly and outwardly of the tubular base members; and further includes elongate cross members being mounted upon the shaft members with each of the cross members interconnecting a pair of the shaft members; and also includes elongate footrest support member being pivotally disposed between and interconnecting the elongate cross members; and further includes footrest members being mounted to the elongate footrest support member; and also includes an assembly of raising and lowering the footrest members.

8 Claims, 3 Drawing Sheets

HEIGHT-ADJUSTABLE FOOTREST FOR TOILETS

BACKGROUND OF THE INVENTION

1. Field of the Invention

The present invention relates to height-adjustable toilet-used footrests and more particularly pertains to a new height-adjustable footrest for toilets for preferably using while a user is seated upon a toilet stool.

2. Description of the Prior Art

The use of height-adjustable toilet-used footrests is known in the prior art. More specifically, height-adjustable toilet-used footrests heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,254,514; U.S. Pat. No. 5,933,877; U.S. Pat. No. 4,635,303; U.S. Pat. No. 4,466,140; U.S. Pat. No. 4,713,846; and U.S. Pat. No. Des. 398,678.

While these devices fulfill their respective, particular objectives and requirements, the aforementioned patents do not disclose a new height-adjustable footrest for toilets. The prior art includes inventions including manually adjustable platforms uses for placing one's feet thereupon while the users are seated upon the toilet seat.

SUMMARY OF THE INVENTION

The general purpose of the present invention, which will be described subsequently in greater detail, is to provide a new height-adjustable footrest for toilets which has many of the advantages of the height-adjustable toilet-used footrests mentioned heretofore and many novel features that result in a new height-adjustable footrest for toilets which is not anticipated, rendered obvious, suggested, or even implied by any of the prior art height-adjustable toilet-used footrests, either alone or in any combination thereof. The present invention includes a base being adapted to rest upon a floor; and also includes upright adjustable support assemblies being mounted upon the base and including tubular base members each having an open top end and a bore extending therein, and also including shaft members being movably disposed inwardly and outwardly of the tubular base members; and further includes elongate cross members being mounted upon the shaft members with each of the cross members interconnecting a pair of the shaft members; and also includes elongate footrest support member being pivotally disposed between and interconnecting the elongate cross members; and further includes footrest members being mounted to the elongate footrest support member; and also includes an assembly of raising and lowering the footrest members. None of the prior art describes the adjustable features and elements of the present invention which makes it easier for the user to adjust the footrest members as desired.

There has thus been outlined, rather broadly, the more important features of the height-adjustable footrest for toilets in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new height-adjustable footrest for toilets which has many of the advantages of the height-adjustable toilet-used footrests mentioned heretofore and many novel features that result in a new height-adjustable footrest for toilets which is not anticipated, rendered obvious, suggested, or even implied by any of the prior art height-adjustable toilet-used footrests, either alone or in any combination thereof.

Still another object of the present invention is to provide a new height-adjustable footrest for toilets for preferably using while a user is seated upon a toilet stool.

Still yet another object of the present invention is to provide a new height-adjustable footrest for toilets that is easy and convenient to move and use in a restroom.

Even still another object of the present invention is to provide a new height-adjustable footrest for toilets that enhances a user's bowel movement while being seated upon the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
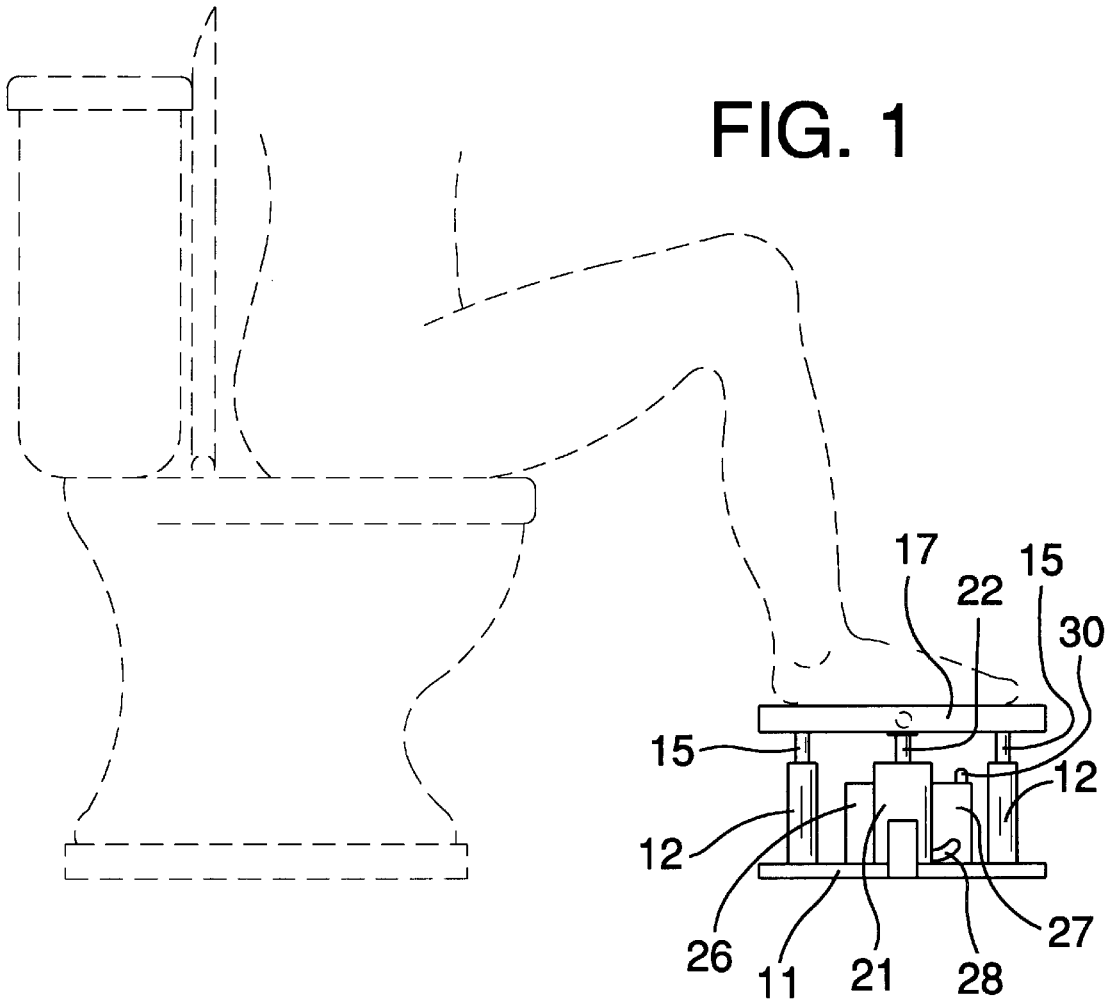
FIG. 1 is a side elevational view of a new height-adjustable footrest for toilets according to the present invention.
Figure 4:
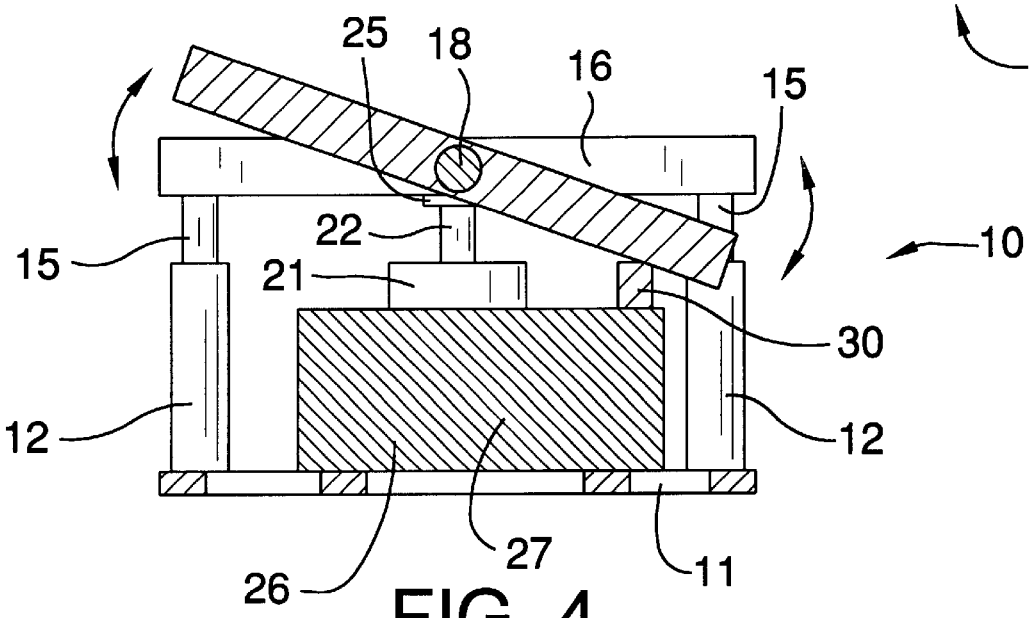
FIG. 4 is another cross-sectional view of the present invention.
Figure 2:
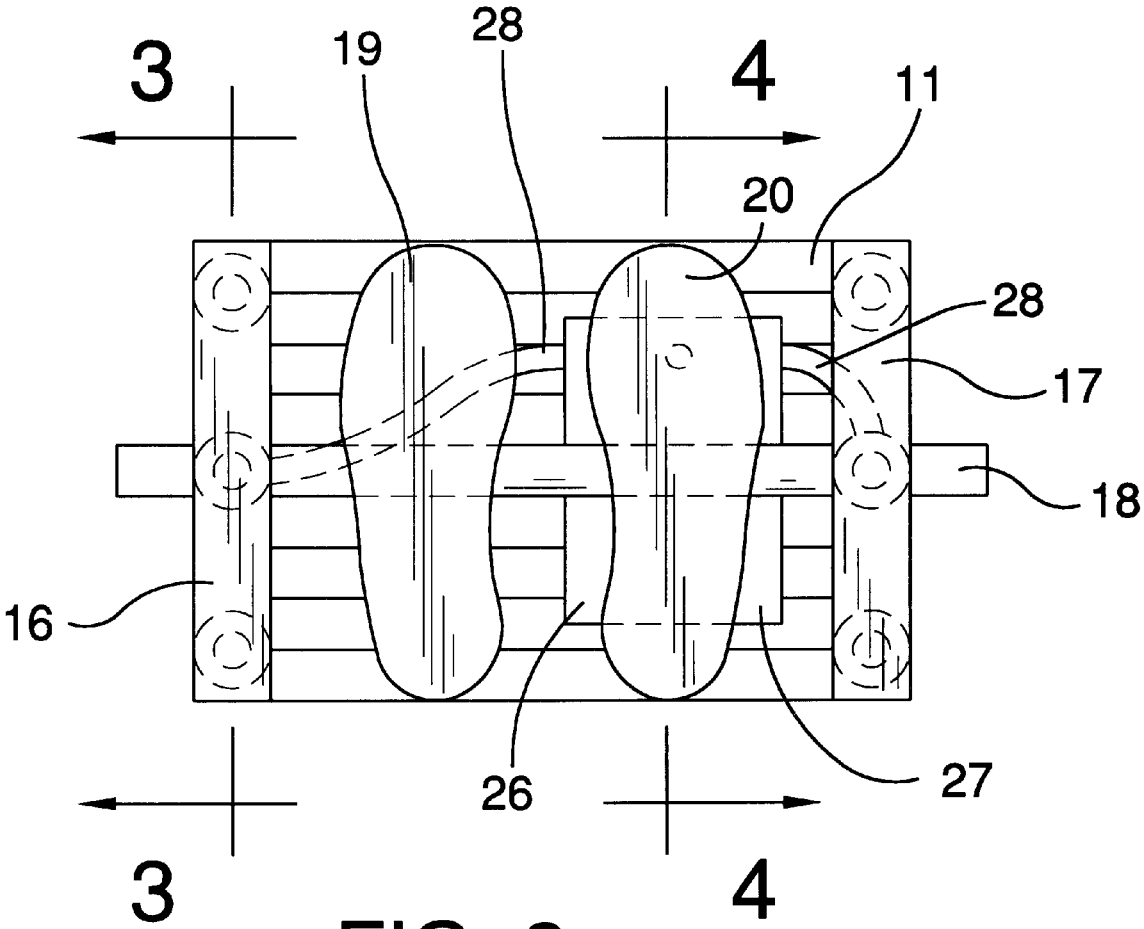
FIG. 2 is a top plan view of the present invention.
Figure 3:
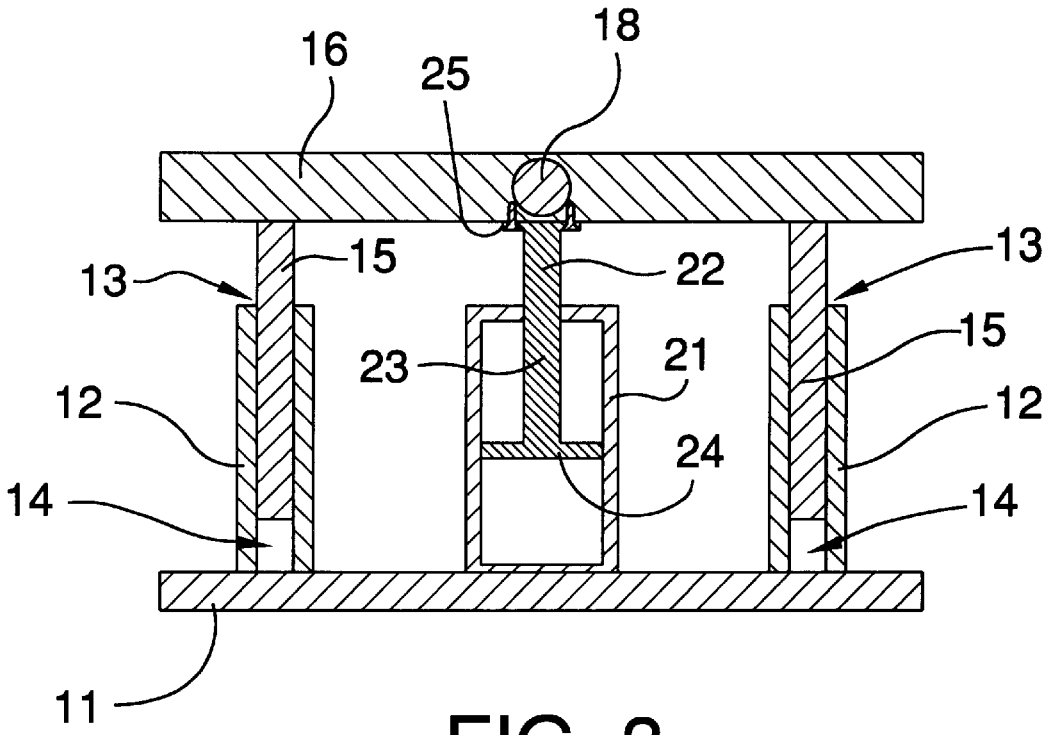
FIG. 3 is a cross-sectional view of the present invention.
Figure 5:
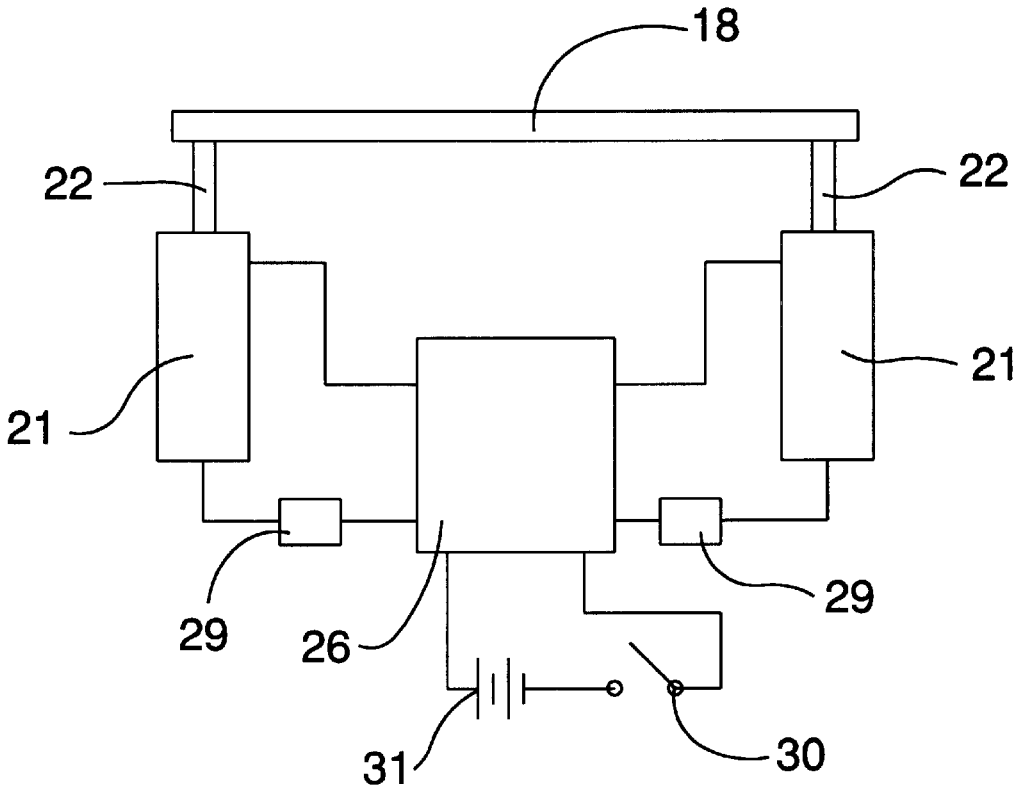
FIG. 5 is a schematic diagram of the present invention.

With reference now to the drawings, and in particular to FIGS. 1 through 5 thereof, a new height-adjustable footrest for toilets embodying the principles and concepts of the present invention and generally designated by the reference numeral 10 will be described.

As best illustrated in FIGS. 1 through 5, the height-adjustable footrest for toilets 10 generally comprises a base 11 being adapted to rest upon a floor. Upright adjustable support assemblies are conventionally mounted upon the base 11 and include tubular base members 12 each having an open top end 13 and a bore 14 extending therein, and also includes shaft members 15 being movably disposed inwardly and outwardly of the tubular base members 12. The tubular base members 12 are securely and conventionally mounted at corners of the base 11.

Elongate cross members 16,17 are conventionally mounted upon the shaft members 15 with each of the cross members 16,17 interconnecting a respective pair of shaft members 15. The elongate cross members 16,17 are generally disposed parallel to one another. An elongate footrest support member 18 is pivotally disposed between and conventionally interconnects the elongate cross members 16,17. The elongate footrest support member 18 is generally a rod which has ends which are pivotally journaled in the elongate cross members 16,17. Footrest members 19,20 are conventionally mounted to the elongate footrest support member 18. The footrest members 19,20 are generally sole-shaped plates having a definite thickness with the rod extending laterally through the bottom sole-shaped plates.

A means of raising and lowering the footrest members 19,20 includes air cylinders 21 each being conventionally mounted between a respective pair of tubular base members 12 along edges of the base 11, and also includes pistons 22 being movably disposed inwardly and outwardly of the air cylinders 21 and being conventionally attached to the elongate cross members 16,17, and further includes an air pump 26 being conventionally mounted upon the base 11 and being connected to the air cylinders 21 for providing compressed air for moving the pistons 22 outwardly and upwardly of the air cylinders 21, and also includes hoses 28 conventionally interconnecting the air pump 26 to the air cylinders 21, and further includes valve members 29 being conventionally disposed inline of the hoses 28, and also includes an on/off switch 30 being depressibly and conventionally disposed upon the air pump 26 and being conventionally connected to a conventional power source 31 and to a motor of the air pump 26 for the energizing thereof. Each of the air cylinders 21 has an opening through a top end thereof and a bore disposed therein, and each of the pistons 22 includes a shaft 23 being movably disposed through the opening and also includes a cap 25 being conventionally attached at a top end of the shaft 23 and upon which a respective one of the elongate cross members 16,17 is securely mounted and further including an annular flange 24 being conventionally disposed about a bottom end of the shaft 23. The on/off switch 30 extends upwardly from a housing 27 of the air pump 26 and is disposed below one of the footrest members 19,20 and is in contactable relationship with the footrest member 19,20.

In use, the user can use one of the footrest members 19,20 to make contact with the on/off switch 30 which energizes the air pump 26 to supply air to the air cylinders 21 to raise the footrest members 19,20 as desired. To lower the footrest members 19,20, the user opens the valve members 29 manually to let the air out of the air cylinders 21.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the height-adjustable footrest for toilets. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A height-adjustable footrest for toilets comprising:

a base being adapted to rest upon a floor;

upright adjustable support assemblies being mounted upon said base and including tubular base members each having an open top end and a bore extending therein, and also including shaft members being movably disposed in and out of said tubular base members;

elongate cross members being mounted upon said shaft members, each of said cross members interconnecting a pair of said shaft members;

an elongate footrest support member being pivotally disposed between and interconnecting said elongate cross members;

footrest members being mounted to said elongate footrest support member; and a means of raising and lowering said footrest members.

2. A height-adjustable footrest for toilets as described in claim 1, wherein said tubular base members are securely mounted at corners of said base.

3. A height-adjustable footrest for toilets as described in claim 2, wherein said elongate cross members are generally disposed parallel to one another.

4. A height-adjustable footrest for toilets as described in claim 3, wherein said elongate footrest support member is generally a rod which has ends which are pivotally journaled in said elongate cross members.

5. A height-adjustable footrest for toilets as described in claim 4, wherein said footrest members are generally sole-shaped plates having a definite thickness with said rod extending laterally through said sole-shaped plates.

6. A height-adjustable footrest for toilets as described in claim 5, wherein said means of raising and lowering said footrest members includes air cylinders each being mounted between a respective pair of said tubular base members along edges of said base, and also includes pistons being movably disposed inwardly and outwardly of said air cylinders and being attached to said elongate cross members, and further includes an air pump being mounted upon said base and being connected to said air cylinders for providing compressed air for moving said pistons outwardly of said air cylinders, and also includes hoses interconnecting said air pump to said air cylinders, and further includes valve members being disposed inline of said hoses, and also includes an on/off switch being depressibly disposed upon said air pump and being connected to a power source and to a motor of said air pump for the energizing thereof.

7. A height-adjustable footrest for toilets as described in claim 6, wherein each of said air cylinders has an opening through a top end thereof and a bore disposed therein, and each of said pistons including a shaft being movably disposed through said opening and also including a cap being attached at a top end of said shaft and upon which a respective one of said elongate cross members is securely mounted and further including an annular flange being disposed about a bottom end of said shaft.

8. A height-adjustable footrest for toilets as described in claim 7, wherein said switch extends upwardly from a housing of said air pump and is disposed below one of said footrest members and is in contactable relationship with said footrest member.

* * * * *